United States Patent [19]

Malinowski et al.

[11] 4,234,915

[45] Nov. 18, 1980

[54] ORNAMENTAL ATTACHMENT FOR DECORATIVE STRING SETS

[75] Inventors: Richard F. Malinowski, Chesterland; Thomas F. Harmon, Chagrin Falls, both of Ohio

[73] Assignee: General Electric Company, Schenectady, N.Y.

[21] Appl. No.: 859,057

[22] Filed: Dec. 9, 1977

[51] Int. Cl.[3] ..... F21P 1/00

[52] U.S. Cl. ..... 362/252; 362/363; 362/391; 362/806

[58] Field of Search ..... 362/252, 363, 391, 396, 362/806, 810, 436

[56] References Cited

U.S. PATENT DOCUMENTS

| | | | |
|---|---|---|---|
| 2,572,382 | 10/1951 | Peterson | 362/396 |
| 2,605,386 | 7/1952 | Syretz | 362/252 X |
| 2,692,374 | 10/1954 | Carson | 362/391 X |
| 2,692,375 | 10/1954 | Carson | 362/391 X |
| 2,759,095 | 8/1956 | Kline | 362/806 X |
| 2,802,095 | 8/1957 | Denning et al. | 362/806 X |
| 3,118,618 | 1/1964 | Holbrook | 362/806 X |
| 3,504,169 | 3/1970 | Freeburger | 362/806 X |
| 3,536,906 | 10/1970 | Bloom | 362/806 X |
| 3,655,495 | 4/1972 | Carrell | 362/252 X |
| 3,676,662 | 7/1972 | Dick | 362/396 |
| 3,968,398 | 7/1976 | Lehmann et al. | 362/806 X |
| 4,012,631 | 3/1977 | Creager | 362/252 |

FOREIGN PATENT DOCUMENTS

| | | | |
|---|---|---|---|
| 137736 | 1/1920 | United Kingdom | 362/252 |

*Primary Examiner*—Peter A. Nelson

*Attorney, Agent, or Firm*—Lawrence R. Kempton

[57] ABSTRACT

An ornamental structure for decorative string sets utilizing miniature and subminiature lamps is disclosed in which a seamless ornament is securely fastened about the lamp and wires to provide both a decorative and strengthening function.

11 Claims, 3 Drawing Figures

ORNAMENTAL ATTACHMENT FOR DECORATIVE STRING SETS

This invention relates to string sets, such as used on Christmas trees, having series connected, decorative subminiature lamps and, in particular, to an ornamental attachment for these sets.

In the prior art, string sets have been provided with lamps of different colors, obtained by dipping or otherwise coating the lamps with a lacquer or other suitable material to provide the desired color. To color the lamps, it is necessary to transport the lamps from the lampmaking equipment to a color coating operation where the coating is applied and cured. The lamps are then unloaded, accumulated according to color and transported for connection to the cord. As a result of all the handling required, lamp yield is reduced.

In addition to color, a variety of decorative shapes enclosing each lamp have been provided in the prior art. The variety has been limited however because the shapes must be formed in halves which are joined together about the lamp. If the seam between the halves cannot be hidden in the design, great care must be used in assemblying the ornaments, increasing their cost.

The construction of the ornaments is not purely a matter of aesthetics: the ornaments must also attach reliably and securely to the lamps and/or sockets. Further, the construction of the ornaments should facilitate the assembly of the string sets, thereby keeping the total cost of the set low.

Where ornaments are used with integral string sets, ie. where the lamps are permanently attached to the cord in a string set, it is also desirable that the ornament not put any additional strain on the connection between the lamp and the cord.

In view of the foregoing, it is therefore an object of the present invention to provide a new ornament for attachment to a string set.

It is another object of the present invention to provide a unitary ornament which attaches reliably and securely to the string set.

It is a further object of the present invention to eliminate the need to color coat lamps in a decorative string set.

It is another object of the present invention to provide an easily manufactured decorative string set.

It is a further object of the present invention to provide an ornamental attachment which strengthens the lamp connections in integral string sets.

The foregoing objects are achieved by the present invention wherein a blow molded ornament is provided with a neck portion, through which the lamp is inserted, having at least one slot and tabs extending radially outward from said neck for engaging at least one of the conductors of the string set.

A more complete understanding of the present invention can be obtained by considering the following detailed description in conjunction with the accompanying drawings in which.

Figure 1:
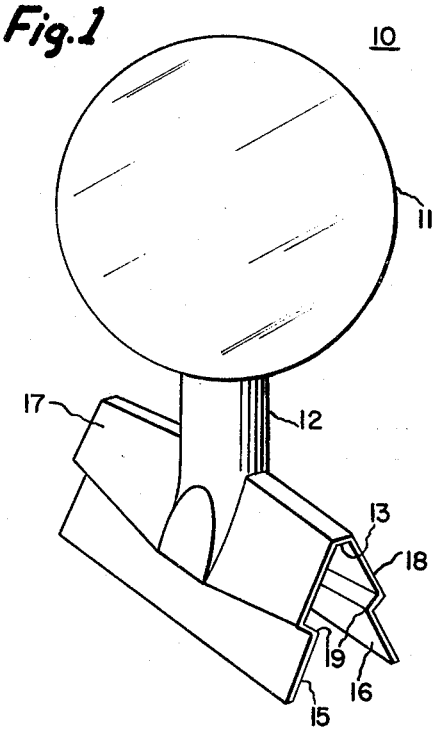
FIG. 1 illustrates an ornament in accordance with a preferred embodiment of the present invention.

FIG. 1 illustrates a preferred embodiment of the present invention in which ornamental structure 10 comprises a shaped portion 11 comprising a hollow shell having neck 12 extending therefrom wherein neck 12 comprises a cylindrical section attached to shaped portion 11 at one end and having a pair of tabs or flanges terminating the other end. As described in more detail herein, shaped portion 11 and neck portion 12 may conveniently comprise the same material formed as a single unit and, depending on the shape of portion 11, may be indistinguishable, eg. where portion 11 is a candle having the same diameter as neck 12.

Tabs 15 and 16 extend from the lower portion of neck 12 and are connected to spaced apart intermediate tabs 17 and 18 by stepped portion 19. Tabs 15 and 17 and tabs 16 and 18 are thus approximately parallel to each other but are oriented by stepped portion 19 so that when tabs 15 and 16 are attached to each other, tabs 17 and 18 form a pair of spaced apart walls defining a channel approximately orthogonal to the axis of cylindrical neck 12. The orthogonal channel assures that tension on the wire(s) therethrough does not act to split the tabs open.

In a preferred form of the present invention, decorative structure 10 is formed as a single unit, for example by blow molding, thereby eliminating any restrictions on the shape of portion 11 due to seams. Ornamental structure 10 may comprise any suitable plastic material and shaped by either injection blow molding or extrusion blow molding. Suitable materials for structure 10 are polyvinyl chloride, or a copolymer of vinyl chloride and propylene, or polycarbonate resin such as commercially available under the trade name "LEXAN".

These materials provide a suitable ornamental structure, the lower portion of which is flexible enough to be opened so that a lamp and the wire or both wires from a string set may be inserted therein. Tabs 15 and 16 are then connected together, either permanently or releasably in any suitable manner known to those of skill in the art.

Figure 2:
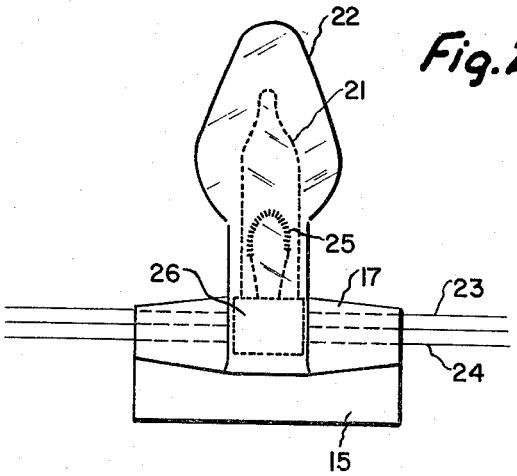
FIG. 2 illustrates a single lamp from a string set in accordance with the present invention.
Figure 3:
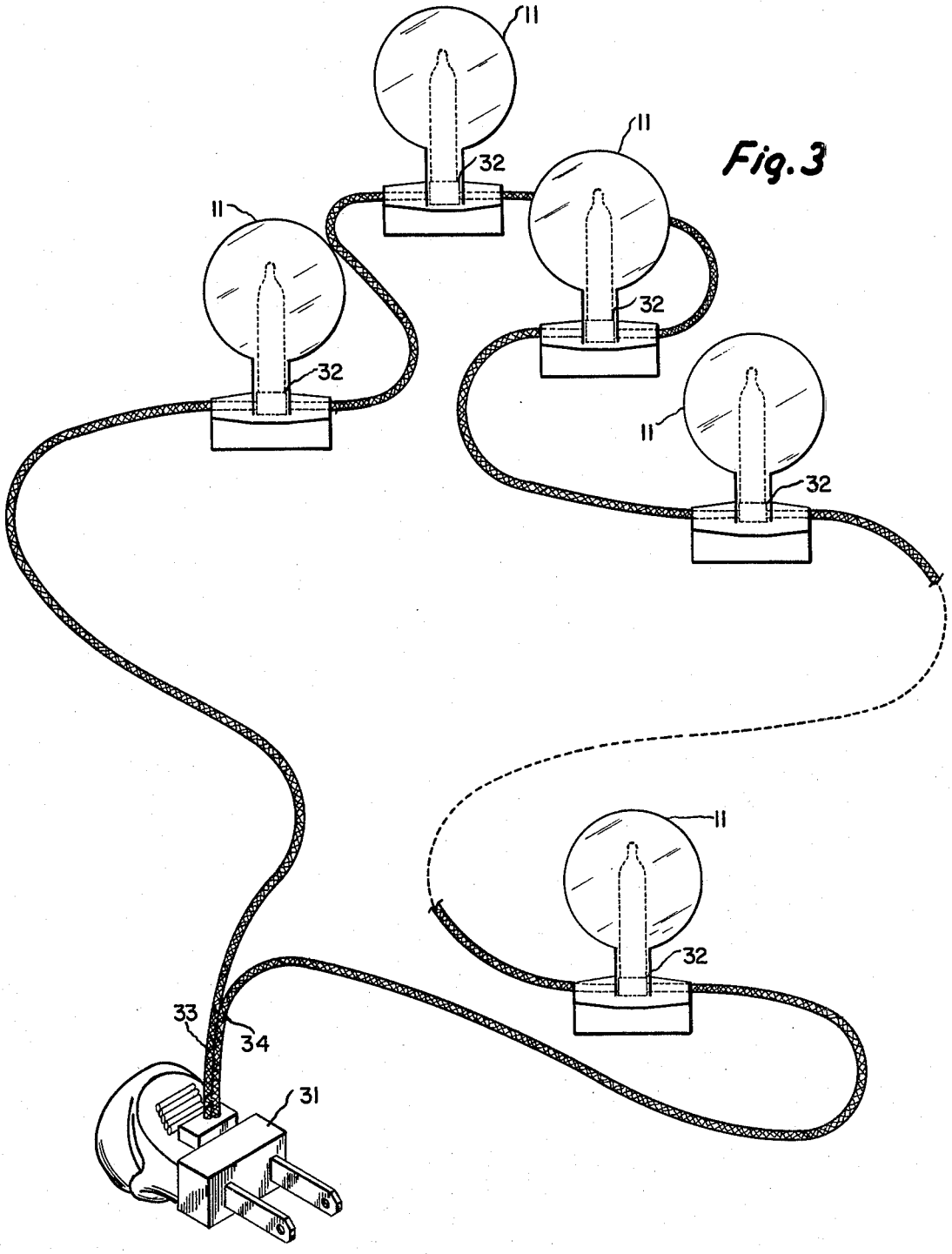
FIG. 3 illustrates the string set having decorative enclosures for the lamps attached thereto in accordance with the present invention.

FIG. 2 illustrates a portion of a string set in accordance with the present invention in which a single lamp and the wires thereto are enclosed by the ornamental structure described in FIG. 1. Specifically, subminiature lamp 21 is enclosed by shaped portion 22, illustrated in FIG. 2 as comprising what is known as the C7 shape of miniature lamps. Subminiature lamp 21 is connected to one of lead wires 23 and 24 by any suitable mechanism known in the art or as described in copending application (Ser. No. 859,055 filed Dec. 9, 1977, filed concurrently herewith and assigned to the assignee of the present invention. Subminiature lamp 21 comprises a clear lamp having a filament 25 therein series connected in one of wires 23 and 24. Base portion 26 of subminiature lamp 21 is enclosed within the aperture defined by tabs 17 and 18 while tabs 15 and 16 are fastened together thereunder, thereby securely attaching the ornamental structure to the string set. In accordance with the present invention, ornamental structure 10 may have any desired shape, such as a decorative shape suitable for the holiday or season or simply the shape of a lamp envelope. As previously noted, the plastic materials can be any desired color, thereby providing the user with a wide variety of decorative possibilities.

When used in conjunction with integral string sets, ornamental structure 10 is permanently attached to the string set, for example by ultrasonic welding. When so attached, ornamental structure 10 further strengthens the string set by immobilizing and protecting the subminiature lamp and electrical connections contained